United States Patent [19]

Haina et al.

[11] 4,240,133

[45] Dec. 16, 1980

[54] QUASIMONOCHROMATIC LIGHT SOURCE

[75] Inventors: Diether Haina, Hähnlein; Willi Poth, Rossdorf; Wilhelm Waidelich, Ober-Ramstadt, all of Fed. Rep. of Germany

[73] Assignee: Gesellschaft für Strahlen-und Umweltforschung mbH, München, Neuherberg, Fed. Rep. of Germany

[21] Appl. No.: 897,865

[22] Filed: Apr. 19, 1978

[30] Foreign Application Priority Data

Apr. 19, 1977 [DE] Fed. Rep. of Germany ..... 2717233

[51] Int. Cl.[3] ..... F21V 9/00; F21V 29/00

[52] U.S. Cl. ..... 362/293; 362/294; 362/345; 362/373

[58] Field of Search ..... 362/293, 294, 345, 373; 350/1.2, 1.3, 1.4, 311, 316

[56] References Cited

U.S. PATENT DOCUMENTS

| | | | |
|---|---|---|---|
| 2,960,415 | 11/1960 | Polan | 350/316 |
| 3,151,208 | 9/1964 | Alpert | 350/316 |
| 3,410,626 | 11/1968 | Magrath | 350/316 |
| 3,593,019 | 7/1971 | Martinez | 362/294 |
| 3,703,635 | 11/1972 | Burkarth | 362/293 |
| 3,704,928 | 12/1972 | Coombs | 350/316 |
| 3,930,149 | 12/1975 | French | 362/293 |

*Primary Examiner*—Donald P. Walsh

*Attorney, Agent, or Firm*—Spencer & Kaye

[57] ABSTRACT

For enabling a quasimonochromatic high intensity light beam to be produced by a source having a lamp equipped with a cold light mirror, a heat protection filter in the light beam path and a system for cooling the heat protection filter, the source is further provided with an interference filter and projection optics located in the beam path downstream of the heat protection filter, and the interference filter is disposed in the optics.

8 Claims, 4 Drawing Figures

QUASIMONOCHROMATIC LIGHT SOURCE

BACKGROUND OF THE INVENTION

The present invention relates to a light source whose exit beam has a high energy density of the type composed of a lamp having a cold light mirror, and a heat protection filter in the optical beam path with cooling being provided for the heat protection filter.

Numerous photochemical and photobiological processes require high illumination intensities of monochromatic or quasimonochromatic radiation. The radiation dose for psoriasis treatments, for example, as well as for light radiation treatments in the oral cavity, is about 1 J (joule)/cm$^2$ (see, for example, Zeitschrift für Experimentelle Chirurgie und Chirurgische Forschung [Journal for Experimental Surgery and Surgical Research] (1974) 9–17). If the irradiation periods are to be kept short, the radiation intensity must lie in the order of magnitude of 50 mW/cm$^2$.

Spectral lights can not be used for this purpose because they have too large a luminous volume and their light cannot be sufficiently focused. Although it is possible to produce monochromatic or quasimonochromatic light from white dot-shaped light sources with the aid of grid or prism spectrographs, this approach does not permit the desired illumination intensities to be produced due to the required slit-shaped illumination. Moreover, the necessary optical equipment is expensive.

High illumination intensities could easily be produced with lasers, but a high energy argon laser and a liquid laser would be required to cover the visible spectral range. The costs and apparatus required for this would be considerable. There also exist cases in which the illumination is intentionally to be done only with incoherent light and not with the highly coherent laser light, for example, when measuring and observing the breathing openings in leaves.

SUMMARY OF THE INVENTION

It is an object of the present invention to provide a high intensity quasimonochromatic light source which has a compact structure, can be used for a plurality of wavelengths and can be operated intermittently, and in which the infrared component of the spectrum is suppressed completely, or almost so.

This and other objects are accomplished according to the present invention by producing quasimonochromatic radiation by: additionally introducing an interference filter into the beam path; providing projection optics downstream of the heat protection filter, with respect to the direction of the beam, for an aperture disposed in front of the heat protection filter; and disposing the interference filter in the protection optics and downstream of the heat projection filter.

In a particularly advantageous embodiment of the invention, the projection optics include a large aperture condenser and a large aperture objective and the interference filter is a broadband interference filter which, when seen in the direction of the beam, is disposed upstream of the objective. The interference filter may then be accommodated in a filter slide disposed in the barrel carrying the lenses of the optics.

According to a further feature of the invention, an axial ventilator transports a steady stream of air from the cold end to the hot end of the condenser while the stream flows over the surfaces of one side of the heat protection filter and the lamp with its cold light mirror.

According to another feature of the invention, the heat protection filter is disposed on a barrel which is provided with one or a plurality of passage openings in its cylindrical surface, the openings being aligned so that the cooling stream impinges on the cooling surface of the heat protection filter.

In one embodiment of the light source according to the invention, the aperture is defined by an iris diaphragm and the lamp mount, the iris diaphragm and the supporting plate are adjustable, or the condenser and the lens barrel are also adjustable.

In a particularly advantageous embodiment of the invention for producing an intermittent exit beam, the beam path can be periodically interrupted in time by means of a sector disc disposed behind the iris diaphragm.

DESCRIPTION OF THE PREFERRED EMBODIMENTS

Figure 1:
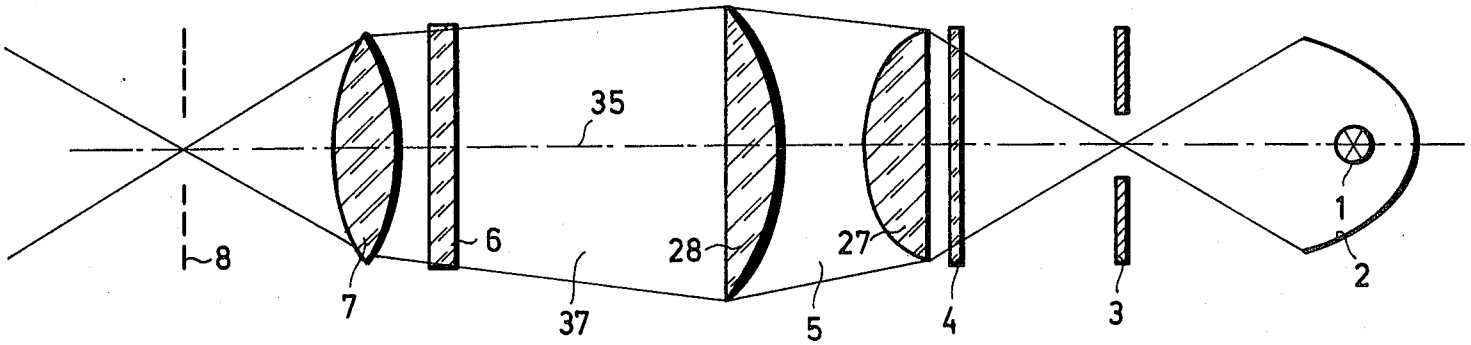
FIG. 1 is a simplified schematic representation of the optical beam path in a source according to the invention.

The basic optical structure of a light source according to the invention can be seen in FIG. 1. The lamp employed is a 150 W halogen lamp 1 with a cold light reflector 2, the cold light reflector 2 being made of a known suspension of a dielectric material. This reflector 2 focuses the light from lamp 1. In the plane of the smallest beam cross section, or beam convergence, a variable diameter adjustable iris diaphragm 3 is disposed to serve as a light field aperture.

After passing through a heat protection filter 4 disposed downstream of the iris diaphragm 3, with respect to the direction of the beam, the light is made nearly collimated by means of a double condenser 5 having two lenses 27 and 28, and then passes in this form through interference filter 6 which permits passage of only a narrow wavelength range, i.e. which makes the light quasimonochromatic. The objective lens 7 reproduces the image of the iris diaphragm 3 in the illumination plane 8.

With thermal, i.e. black, radiators, the spectral emission is described by the Planck radiation formula and the emission maximum wavelength depends on the lamp filament temperature. The descending curve portion in the direction toward long wavelengths has a substantially flatter slope than the portion in the direction toward shorter wavelengths. With a light filament temperature of 2500° C., the emission maximum lies at 1.04$\mu$, i.e. already in the infrared spectral range. The high proportion of infrared radiation must therefore be suppressed at least almost entirely. Initially, the cold light reflector 2 has the property of reflecting all visible light but only part of the infrared light. The infrared light which is not reflected passes through reflector 2 or is absorbed in it, and is thus eliminated from the beam path.

Even good interference filters 6 block infrared radiation only up to wavelengths of $1\mu$ or $1.1\mu$, longer wave radiation being permitted to pass. In embodiments of the present invention, the filter is a broadband interference filter with a peak transmission wavelength $\lambda=632$ nm, a half-intensity bandwidth of 18 nm, a transmission of 90% and blocking down to X-rays and up to $1.07\mu$ at a transmission of $<0.01\%$. The filter is manufactured by Dr. Hugo Anders KG, Nabbury, West-Germany.

The heat protection filter 4 serves the purpose of absorbing the remaining interfering infrared radiation which of course causes a considerable amount of heat to be developed in it. Therefore provision must be made for cooling the surfaces of filter 4 in order to make it possible for the heat protection filter to withstand the thermal stress. Filter 4 can be constituted by a Model KG3 manufactured by the Schott Co.

Figure 2:
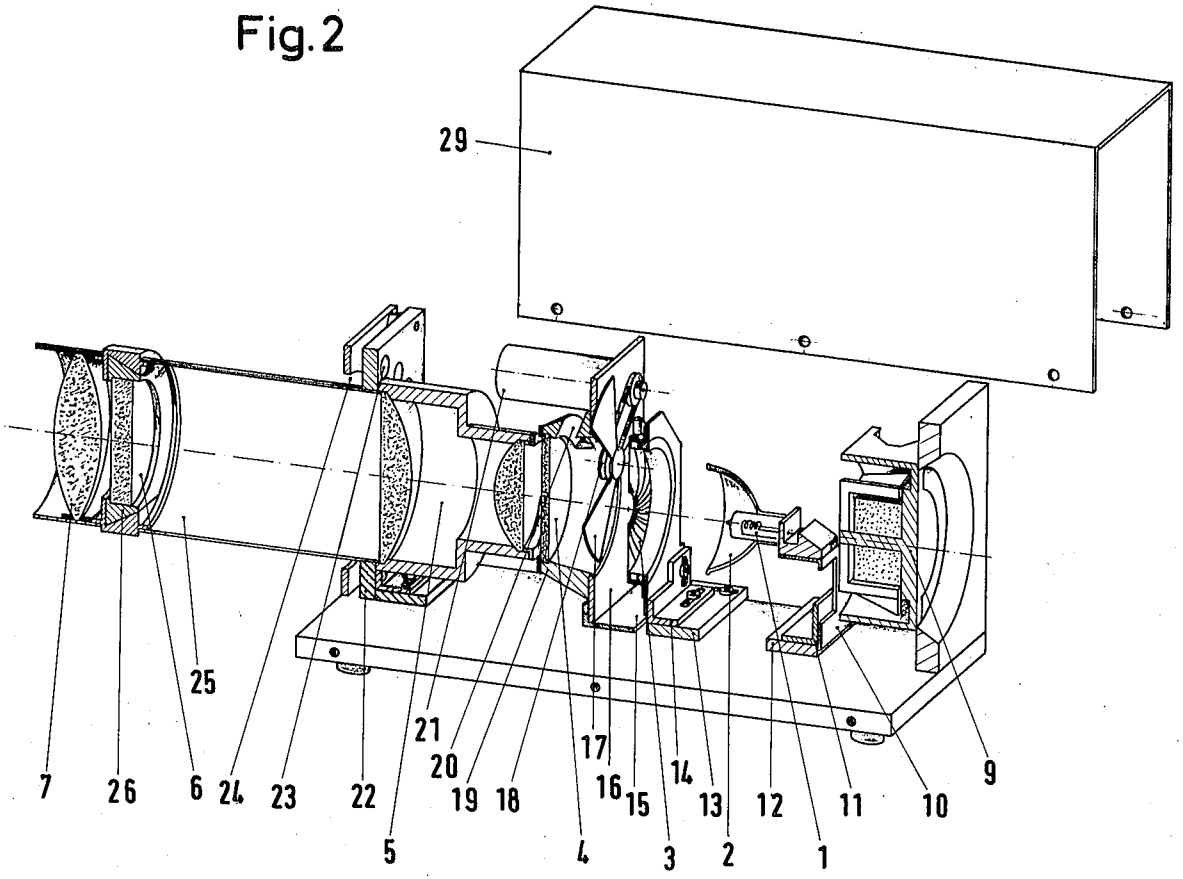
FIG. 2 is a partial cross-sectional perspective view of a preferred embodiment of the light source according to the invention with its housing removed.
Figure 3:
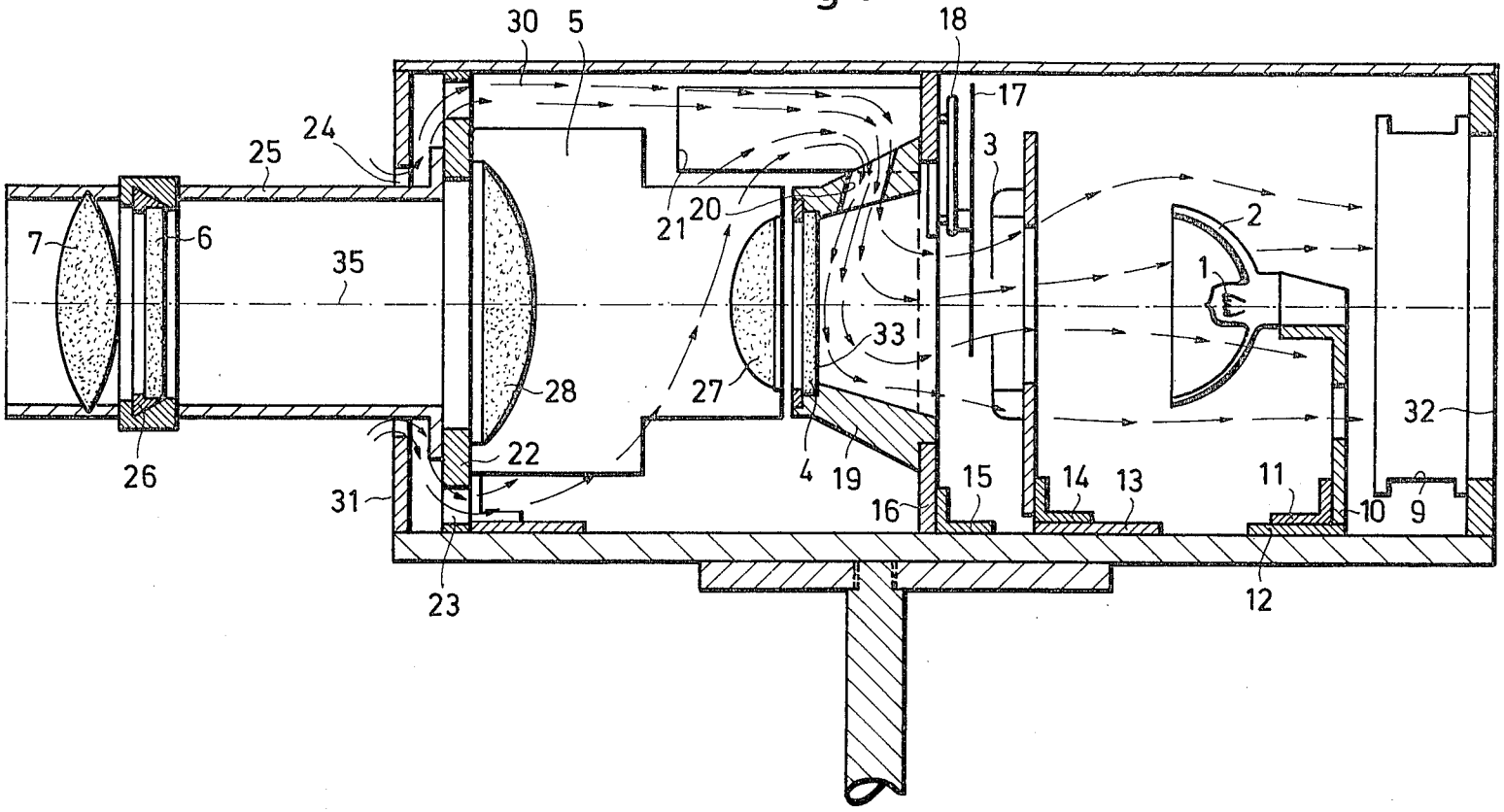
FIG. 3 is a cross-sectional detail view of the light source of FIG. 2, showing the cooling air stream.

FIG. 2 is a perspective view of the light source assembly with its housing cover 29 removed, while FIG. 3 is a cross-sectional view of the optical assembly. As shown in FIG. 3, an axial ventilator 9 which can be a Papst, Model 8556 unit, sucks a steady stream of air 30 from the cold end 31 to the hot end 32 of the lamp. The stream of air, or the cooling air, 30 passes through an annular gap 24 around the lens barrel 25 and through holes 23 which are arranged in a circle around the lens mount plate 22 into the light source and first flows around the condenser 5 and a motor 21, as well as an electric current supply and an electronic speed regulation unit disposed below condenser 5, but not shown in the drawing, for motor 21. Heat protection filter 4 is mounted in a support plate 16 which forms an airtight seal with the light source housing cover 29 when the latter is in place, forcing the entire stream of cooling air 30 to pass through a slit 20 in the heat protection filter barrel 19, flow adjacent the heat protection filter surfaces, and cool the surface of the filter cooling face 33. Then the cooling stream 30 flows around an interrupter, or shutter, disc 17, which is driven by motor 21, and then around iris diaphragm 3 and finally the halogen lamp 1 with the cold light reflector 2.

The light field aperture in the form of an iris diaphragm 3, which is arranged in the plane of the smallest beam cross section, serves several purposes. During adjustment of the light source according to the invention the diaphragm is closed to the extent that only the beam coming from the halogen lamp 1 and the reflector 2 can pass, but not marginal and stray beams. The plane of greatest illumination intensity lies in the plane in which the iris aperture is projected by lens 7, this being the plane of illumination 8. Plane 8 is about 8 cm removed from the lens 7 and is located so that a focused image of the iris aperture 3 of a diameter of about 13 mm is formed. For some cases this illuminated area in the plane of illumination 8 is too large. In order to reduce its size, the iris aperture 3 is closed to the desired value.

To produce high illumination densities, condenser 5 must have as large a diameter and as short a focal length as possible. At the same time, however, it must have relatively high resolution properties since it contributes to the projection of the image of iris aperture 3. In the present case the condenser 5 was designed to have a focal length of 75 mm and a relative aperture (ratio of linear aperture to focal length) of 1:1. Requirements similar to those for condenser 5 also apply for the objective lens 7. In this case, a dual element objective lens was used which had a focal length of 80 mm and a relative aperture of 1:1.6.

The resulting light yields depend quite considerably on the properties of the interference filter 6 employed. High transmission over the entire desired wavelength range assures optimum yield. The transmission curves of conventional interference filters have relatively shallow slopes. In the present case, the transmission curve should have an almost rectangular shape. Therefore a broadband interference filter of the four-reflector type having the above mentioned parameters was employed. In order to be able to quickly exchange interference filters, a filter slide 26 is provided in the lens barrel 25 and is formed so that it can be pulled out to the side, i.e. perpendicular to the light beam axis 35 and, relative to the views of FIGS. 2 and 3, in a horizontal direction, to exchange the interference filter 6.

For some purposes, for example for examining time-dependent biological processes, it is necessary to illuminate with pulsating or alternating light. Moreover, in some measuring processes it is advisable to have intermittent illumination in order to permit electronic suppression of an existing direct light component. A ball-bearing mounted sector, or shutter, disc 17 driven by a d.c. motor 21 can interrupt the light beam periodically immediately downstream of the iris diaphragm 3. The rate of rotation of the motor 21 can be adjusted by setting a potentiometer (not shown) so that the light beam is interrupted between 5 to 30 times per second, if the disc has three equispaced sectors or shutters.

Since the apertures of all optical elements are adapted to one another, the halogen lamp 1 with the cold light reflector 2 and the iris diaphragm 3 must be precisely adjustable so as to produce a high optical illumination intensity. With every halogen lamp replacement it is absolutely necessary to perform a readjustment because, due to manufacturing tolerances, the filaments of the lamps do not always sit at precisely the same spot. The lamp base 10 may therefore be displaced in all three spatial directions by means of elongated holes (not visible) in the fastening angle 11 and in the base plate 12. A corresponding displacement of the iris diaphragm 3 can be effected via fastening angle 14 and base plate 13 by means of elongated holes which can be seen in FIG. 2. The heat protection filter carrier plate 16 can be displaced in the direction of the optical axis 35 by means of elongated holes (not visible) in its fastening angle 15.

Preferably, lens mount plate 22 is similarly mounted to permit its position to be adjusted.

Figure 4:
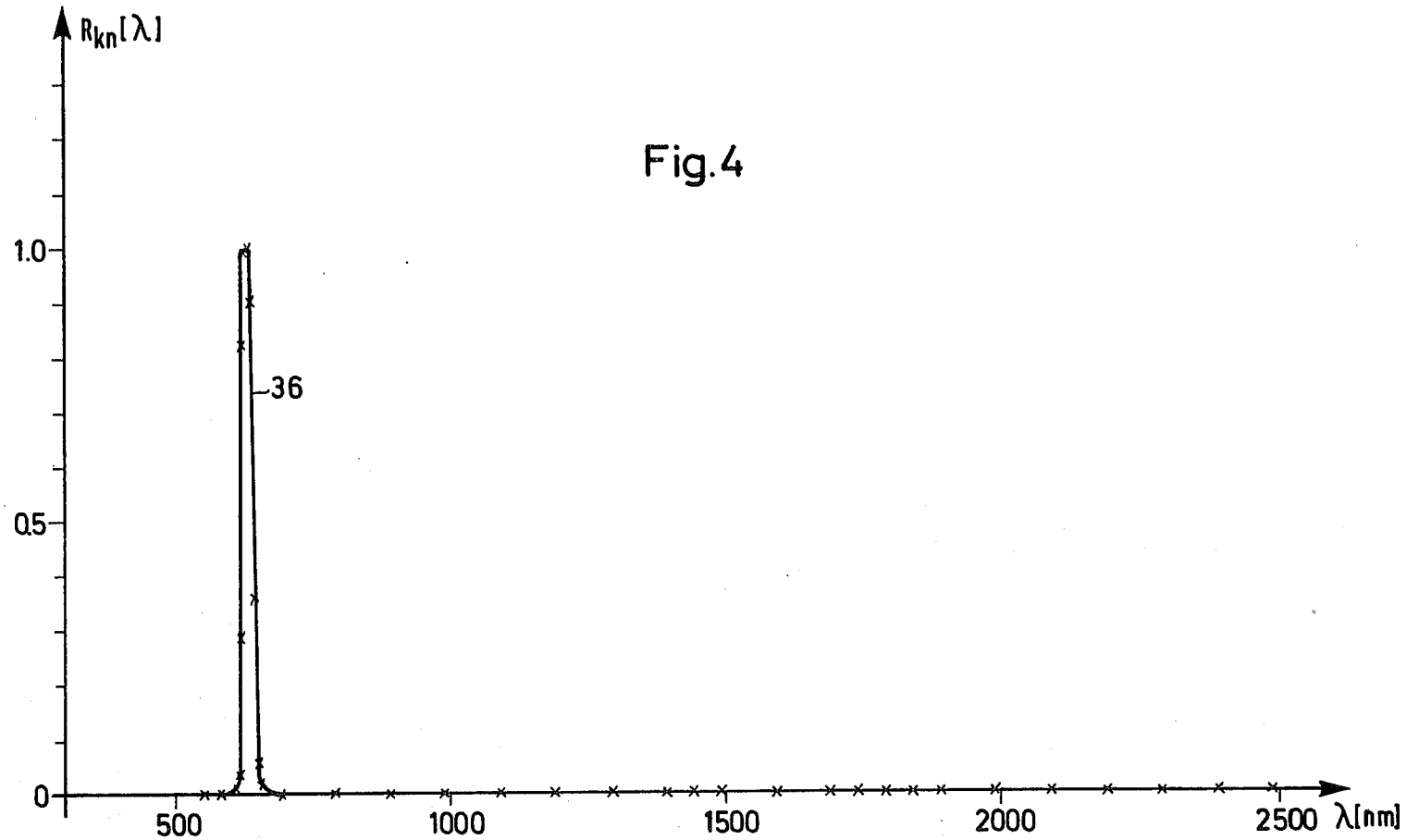
FIG. 4 is a diagram of the spectrum of the exit beam produced by the light source of FIGS. 1–3.

In one practical embodiment of the invention, the lamp housing 29 has dimensions of 30 cm×12.4 cm×13.2 cm, and the lens barrel 25 has a diameter of 7.7 cm and protrudes 14.7 cm from the housing. When the above-mentioned type of filter 6 is used together with a 150 W cold light mirror-halogen lamp assembly 1, 2, a power of 160 mW is produced across an area 13 mm in diameter in the plane of illumination 8, which corresponds to an illumination intensity of 120 $mW/cm^2$. This illumination intensity can be reduced by reducing the lamp current via a control transformer connected in the mains supply of the lamp (not shown). Measurement of the spectral emission $R(\lambda)$ over the wavelength $\lambda$ (nm) shows, as can be seen in FIG. 4, that heat radiation is effectively suppressed. A peak 36 of almost monochromatic light is produced.

It will be understood that the above description of the present invention is susceptible to various modifications, changes and adaptations, and the same are intended to be comprehended within the meaning and range of equivalents of the appended claims.

We claim:

1. In a light source producing an exit beam of high energy density and including a lamp with a cold light mirror, a heat protection filter in the path of the beam produced by the lamp, and means for cooling the heat protection filter, the improvement comprising: an interference filter disposed in the beam path; and projection optics disposed in the beam path downstream of said heat protection filter, with respect to the direction of the beam; and wherein said means for cooling comprise an axial ventilator arranged to transport a steady stream of cooling air from the downstream end to the upstream end of said condenser while brushing over the surface of one side of said heat protection filter and flowing past said lamp with its cold light mirror, and said interference filter is disposed in said optics and downstream of said heat protection filter; whereby said source produces nearly monochromatic radiation.

2. A device as defined in claim 1 wherein said projection optics comprise a wide-open condenser and a wide-open objective lens; and said interference filter is a band-pass filter and is disposed upstream of said objective lens with respect to the direction of the beam.

3. A device as defined in claim 2 further comprising a lens barrel carrying said optics, and a filter slide disposed in said lens barrel and carrying said interference filter.

4. A device as defined in claim 1 further comprising a heat protection filter supporting barrel carrying said heat protection filter and provided with a cylindrical surface having a passage opening oriented to cause the cooling air stream to impinge on a surface of said heat protection filter.

5. A device as defined in claim 1 further comprising an iris diaphragm disposed upstream of said optics and defining a light beam entrance aperture for said optics.

6. A device as defined in claim 5 further comprising a sector disc disposed downstream of said iris aperture for periodically blocking the light beam path.

7. A device as defined in claim 1 further comprising means individually supporting, and permitting adjustable positioning of, each of said lamp with its mirror, said diaphragm, and said heat protection filter.

8. A device as defined in claim 7 further comprising means supporting said optics and interference filter for permitting adjustable positioning thereof.

* * * * *